US007040785B2

(12) United States Patent
Stegmaier

(10) Patent No.: US 7,040,785 B2
(45) Date of Patent: May 9, 2006

(54) HEADLIGHT WITH A HOUSING THAT IS PROVIDED WITH FIXING CLAWS

(75) Inventor: Klaus-Dieter Stegmaier, Viechtach (DE)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 138 days.

(21) Appl. No.: 10/475,820

(22) PCT Filed: Apr. 23, 2002

(86) PCT No.: PCT/DE02/01529

§ 371 (c)(1),
(2), (4) Date: Apr. 21, 2004

(87) PCT Pub. No.: WO02/086383

PCT Pub. Date: Oct. 31, 2002

(65) Prior Publication Data

US 2004/0170023 A1 Sep. 2, 2004

(30) Foreign Application Priority Data

Apr. 23, 2001 (DE) ..... 201 07 299 U

(51) Int. Cl.
*F21V 17/10* (2006.01)
*F21V 3/00* (2006.01)

(52) U.S. Cl. ..... 362/455; 362/374; 362/433; 362/509

(58) Field of Classification Search ..... 362/267, 362/369, 374, 375, 390, 433, 436, 438, 455, 362/456, 509, 510, 546
See application file for complete search history.

(56) References Cited

U.S. PATENT DOCUMENTS

| | | | | |
|---|---|---|---|---|
| 1,303,898 | A * | 5/1919 | Herskovitz | 362/433 |
| 1,344,695 | A * | 6/1920 | Thompson | 362/375 |
| 1,714,289 | A * | 5/1929 | Albright | 362/374 |
| 1,761,511 | A * | 6/1930 | Wolarsky | 362/433 |
| 2,291,495 | A * | 7/1942 | Beals | 362/374 |
| 4,187,534 | A * | 2/1980 | Tichenor et al. | 362/455 |
| 4,604,679 | A * | 8/1986 | Rolando et al. | 362/267 |
| 4,922,386 | A * | 5/1990 | Bockeler et al. | 362/509 |
| 5,091,835 | A | 2/1992 | Malek et al. | |

(Continued)

FOREIGN PATENT DOCUMENTS

DE 41 27 128 A1 2/1993

(Continued)

OTHER PUBLICATIONS

English translation of International Preliminary Examination Report dated Jul. 11, 2003 for PCT/DE02/01529.

(Continued)

*Primary Examiner*—Alan Cariaso
(74) *Attorney, Agent, or Firm*—Christie, Parker and Hale, LLP

(57) ABSTRACT

A headlight with a housing, in which light-generating and light-forming elements are arranged. The front part of the housing or a top, insert or attachment linked with the front part of the housing, is provided with at least two fixing claws for fixing accessory parts such as a diffuser, color film filter or wing elements that can be mounted on the light outlet of the headlight by the fixing claws. The fixing claws are characterized by one elastic element each or configure such an element on which an accessory part held by the fixing claw rests, thereby reducing undesired clattering noises.

13 Claims, 6 Drawing Sheets

U.S. PATENT DOCUMENTS 5,735,596 A * 4/1998 Daumueller ..... 362/267
6,033,095 A * 3/2000 Ognian ..... 362/375

FOREIGN PATENT DOCUMENTS

DE 42 10 439 A1 10/1993
DE 296 21 615 U1 4/1997
DE 196 12 048 A1 10/1997
DE 201 07 299 U1 9/2001
EP 0 620 400 A1 10/1994

OTHER PUBLICATIONS

International Search Report of PCT/DE02/01529, dated Aug. 23, 2002.
International Preliminary Examination Report of PCT/DE02/01529, dated Jul. 11, 2003.

* cited by examiner (PRIOR ART)

(6c-6c)

HEADLIGHT WITH A HOUSING THAT IS PROVIDED WITH FIXING CLAWS

CROSS-REFERENCE TO RELATED APPLICATION

This application is a National Phase Patent Application of International Application Number PCT/DE02/01529, filed on Apr. 23, 2002, which claims priority of German Patent Application Number 201 07 299.8, filed on Apr. 23, 2001.

BACKGROUND

The invention relates to a headlight with a housing with fixing claws.

It is known to attach accessory devices such as diffuser, colour film filter or wing elements on the light outlet of the headlight to influence the lighting. Accessory devices of this kind are normally suspended in fixing claws which are fixed to the front part of the housing or to a top, insert or attachment linked to the front part of the housing. A corresponding arrangement is shown in FIG. 5.

FIG. 5 shows a prior art headlight 1 whose light-generating and light-forming elements, more particularly a lamp, lamp holder, reflector and lens system (each not shown) are mounted in a housing 2. The housing 2 consists of a front part 21, a centre part 22 and a back part 23. The front part 21 and back part 23 are preferably cast aluminium parts whilst the centre part 22 is preferably an extruded aluminium profiled section. On the centre part 22 are two bar holders (not shown) through which one bar can be connected to the housing 2 in known way. The headlight is preferably mounted on a stand through the bar.

The front part 21 of the housing consists of an annular front ring 21*a* and a lens socket 21*b* fixedly connected thereto into which the lenses of the headlight are inserted. Four fixing claws 51, 52, 53, 54 which protrude relative to the front part 21 are mounted uniformly spaced on the front ring 21*a*. The side fixing claws 51, 53 and the bottom fixing claw 54 are thereby fixedly secured to the front ring 21*a*. The upper fixing claw 52 is provided with an opening mechanism and can be tipped up and away from the illustrated position.

Each fixing claw 51, 52, 53, 54 has two grooves 61, 62 which serve to hold the accessory devices. Instead of two socket grooves it is thereby also possible to provide only one socket groove or three and more socket grooves in each one fixing claw 51, 52, 53, 54.

It should be pointed out that the fixing claws 51, 52, 53, 54 can also be formed directly on the lens socket 21*b* instead of in a front ring 21*a* or can be formed on a part which is inserted or fitted in front of or on top of the lens socket.

As already mentioned, the fixing claws 51, 52, 53, 54 serve to hold accessory devices such as diffuser, colour film filter and wing members which are hung in the fixing claws or the socket grooves 61, 62 of the fixing claws. Owing to the heat thrown out by the headlight the accessory item is normally fitted in metal frames which are then inserted in the socket grooves 61, 62 of the fixing claws.

In order to insert the metal frames the upper fixing claw 52, which is provided with an opening mechanism, is tipped upwards and after the inserting the metal frame is tipped back again into the position illustrated in FIG. 5.

The metal frames used for the accessories have a certain play like the fixing claws. In particular the play of the metal frames is very considerable in part. This has the result that the accessory or the metal frames of the accessory in the case of a movable headlight used, for example in reporting or in sockets in cars or other movable sockets causes rattling noises in the fixing claws. A rattling noise of this kind is undesired particularly if a sound recording is being made at the same time.

From DE 196 12 048 A1 a light housing is known having a detachable light cover which is held in two opposite parallel grooves. A resilient element is fitted in at least one of the grooves and the light cover resiliently bears against this resilient element.

U.S. Pat. No. 5,091,835 describes a headlight in which a spring clip which is provided on the front lens support ring has recesses for holding a lens or the like.

SUMMARY

The object of the present invention is therefore to provide a headlight which reliably prevents accessory devices such as diffuser, colour film filter, and wing elements mounted in the fixing claws of the headlight from causing rattling noises with movable use of the headlight.

According to the invention, a headlight is provided in which the fixing claws each have or form an elastic element against which bears an accessory device held by the fixing claws. According to the invention, the elastic element is a pin made from an elastic material or a tubular segment made from an elastic material which is fitted axially into a bore of the fixing claw relative to the headlight. The elastic element has an elasticity which is greater than the elasticity of the associated fixing claw. At the same time the elastic element is dimensioned so that it compensates tolerances in the accessory and fixing claws.

According to the invention an accessory device inserted in the fixing claws thus resiliently bears against the elastic element of the relevant fixing claw whereby the elastic element exerts a certain spring force on the accessory device so that this is mounted fixed and rattle-free in the fixing claws. Undesired rattling noise in the event of a movable headlight is safely prevented.

The fixing claws preferably each have a recess for holding accessory devices whereby the elastic element is mounted each time in the recess of the fixing claws. A secure fixing of an accessory device on the fixing claws is thereby possible.

The elastic element is mounted each time in the recess of a fixing claw so that it radially adjoins an accessory device held in the recess. A spring force acting radially on the accessory device is thereby generated by the elastic element which ensures that an accessory device inserted in the fixing claws cannot rattle to and fro in the fixing claws.

As a result of the radially acting spring force exerted on the accessory and the increased friction thus resulting between the accessory device and the elastic element, any axial rattling of the accessory device to and fro in the relevant socket grooves of the fixing claws is also reliably prevented.

The elastic element is preferably a pin which is cylindrical. An elastic pin has the advantage that it can be deformed relatively severely in the radial direction and therefore even in the event of severe tolerances between the accessory device and fixing claw guarantees a secure rattle-free hold of the accessory device.

Instead of a solid pin the elastic element can, in an alternative embodiment, be a hollow pin or a tubular segment made from an elastic material. The formation of the elastic element or pin as a tubular segment represents a simple variation of the embodiment. The elasticity of the tubular segment can be determined through the material and thickness of its wall.

The (at least one) recess of the fixing claw is preferably a groove whereby the pin which is made from an elastic material or the elastic tubular segment is pushed transversely through the groove and thereby protrudes at least in part relative to the groove base so that an accessory device inserted in the groove at its radial end does not contact the groove base but the elastic pin or the tubular segment.

The bore for holding the elastic element is preferably designed in the region of the groove base as a half bore so that one part of the elastic element protrudes from the groove base. A secure fixed connection between the elastic element and fixing claw is hereby achieved. It can further be proposed that the elastic element is secured additionally by an adhesive to the fixing claw. In general the elastic element is preferably fixed to the fixing claw through adhesive or through adhesive in conjunction with a positive locking connection.

In a further embodiment the elastic element protrudes slightly axially relative to the fixing claw. This ensures noise is dampened in the axial direction in respect of elements such as parts of a wing element bearing against the fixing claw on the outside. The axially protruding region of the elastic element is preferably rounded, more particularly ball-shaped.

In an alternative embodiment of the invention, the elastic element is formed as an insert part which is likewise preferably groove-shaped and a fixing claw is inserted each in a socket groove. An insert part of this kind bears both radially and axially against the ends of an accessory device inserted in the fixing claw.

The elastic element which is inserted in the fixing claws preferably has a much higher elasticity compared with the material of the fixing claws so that rattling of the accessory part is reliably prevented and the latter is held resiliently on the headlight. The elastic element is preferably an elastic heat-resistant plastics material, more particularly a rubber elastic material, possibly an elastomer or rubber.

BRIEF DESCRIPTION OF THE DRAWINGS

The invention will now be explained in further detail with reference to the embodiment illustrated in the drawings.

DETAILED DESCRIPTION OF THE INVENTION

A headlight with fixing claws for holding accessory devices such as a diffuser, a colour film filter and wing elements corresponding to the prior art has already been explained in detail with reference to FIG. 5.

Figure 1:
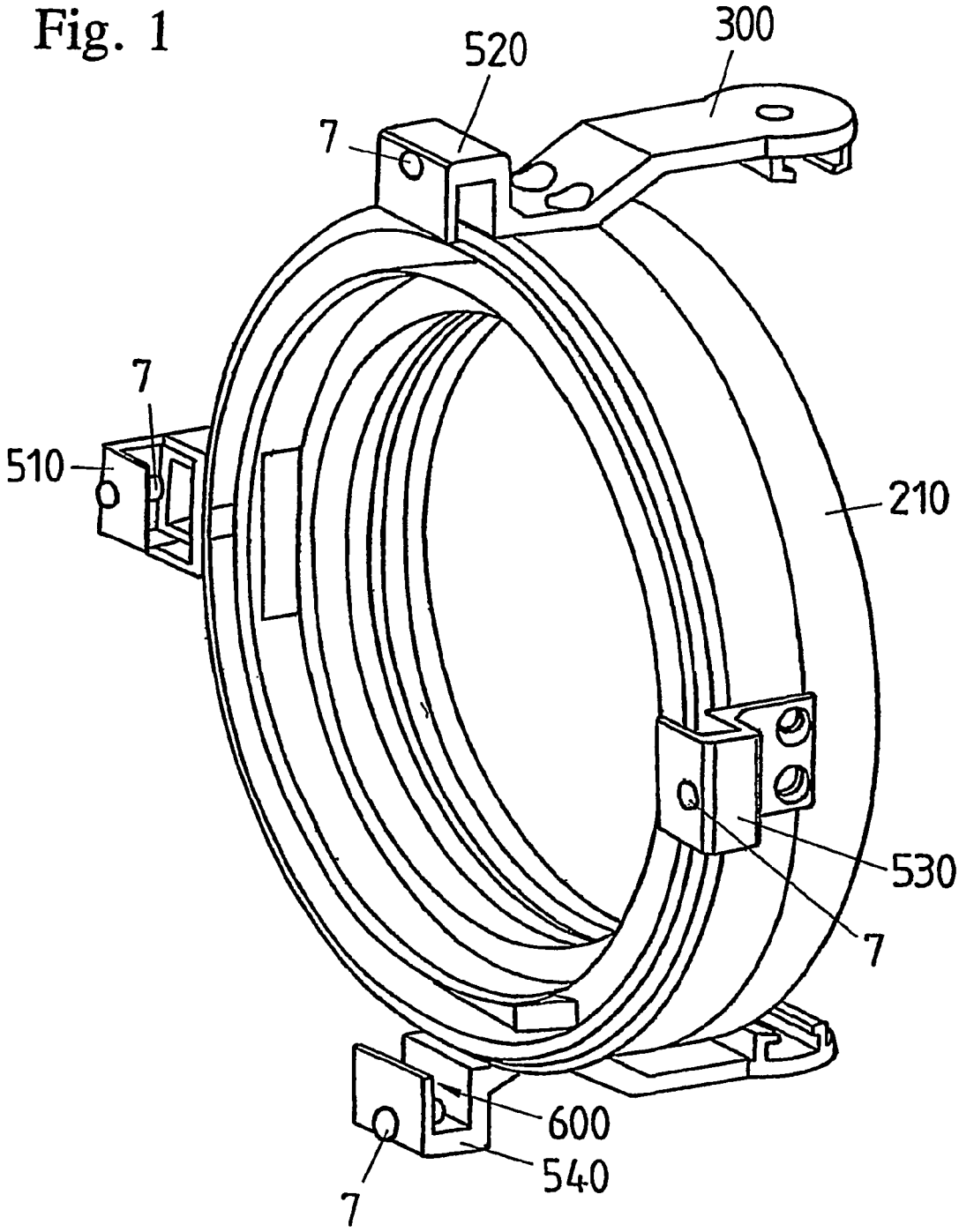
FIG. 1 is a perspective view of the front part of a headlight housing with fixing claws according to the invention mounted thereon.

FIG. 1 shows a front part 210 of a lamp housing with four fixing claws 510, 520, 530, 540 according to the invention mounted thereon. Each fixing claw has an oblong socket groove 600 for holding a socket device which is to be hung in the fixing claws. In particular a metal frame of a socket device is inserted in the grooves 600.

The front part in the illustrated embodiment is a so-called lens gate which serves to hold the lens system of the headlight. The fixing claws 510, 520, 530, 540 can however also be mounted on a different front part, in particular on a top surrounding the lens gate or an adapter set in front of the lens gate (see adaptor 21*a*) of FIG. 5. It can likewise be proposed that the fixing claws can not only have one socket groove 600 but also several socket grooves arranged axially behind each other (see grooves 61, 62 of FIG. 5).

The fixing claws 510, 520, 530, 540 are preferably formed as a cast part, more particularly as an aluminium cast part and firmly screwed or riveted to the front part 210. Alternatively the fixing claws are formed in one piece, more particularly as a one-piece cast part together with the front part 210. It can likewise be proposed that the fixing claws are profiled sheet metal parts or a hard plastics part. The fixing claws 510, 520, 530, 540 have a relatively slight elasticity in order to be able to fix relatively heavy accessories rigidly on the headlight.

Figure 2:
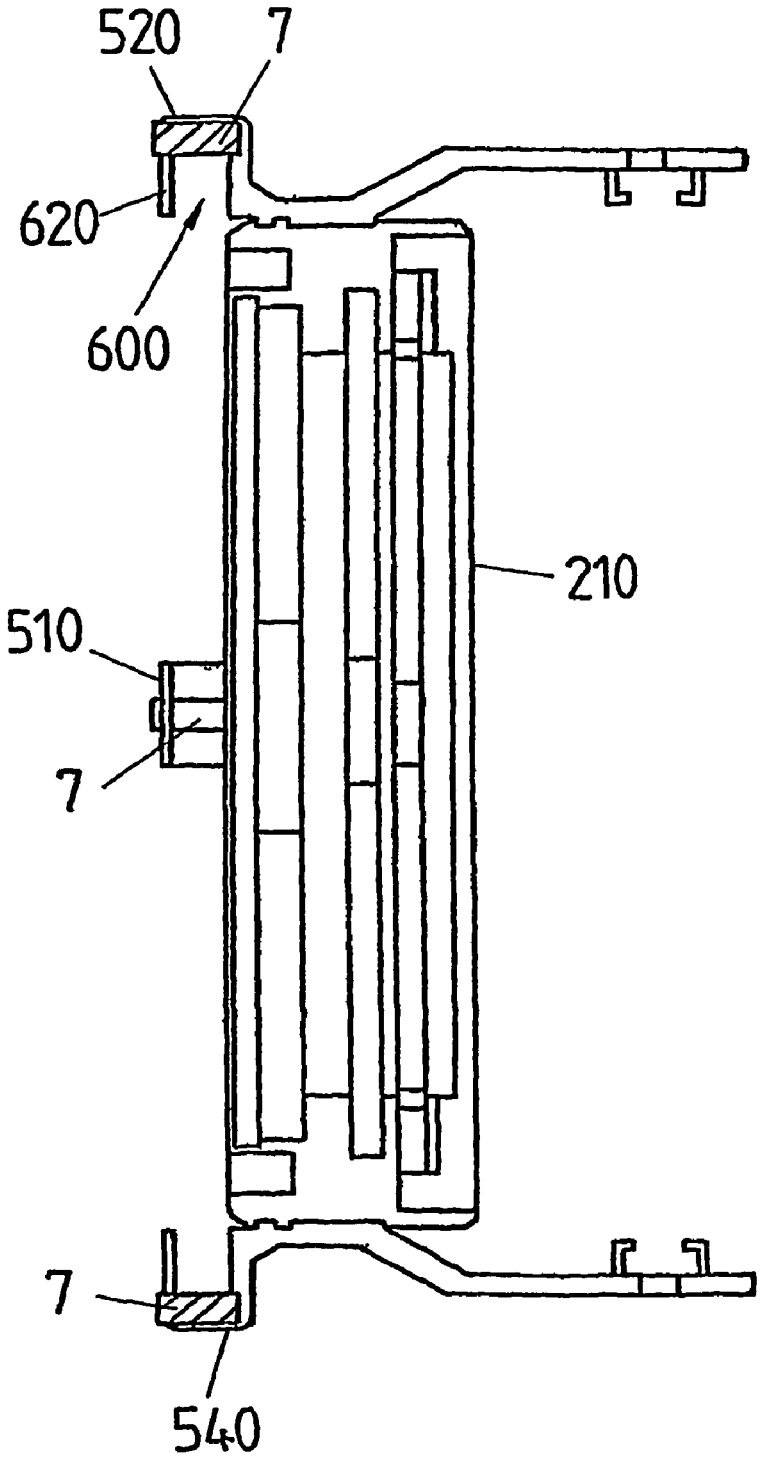
FIG. 2 is a side view partially in section of the front part of FIG. 1.

In the embodiment illustrated in FIGS. 1 and 2 the upper and lower fixing claws 520, 540 have a bar hanger 300 extending backwards to fix a bar (not shown). This bar hanger 300 can basically also be formed on other parts of the housing.

Figure 5:
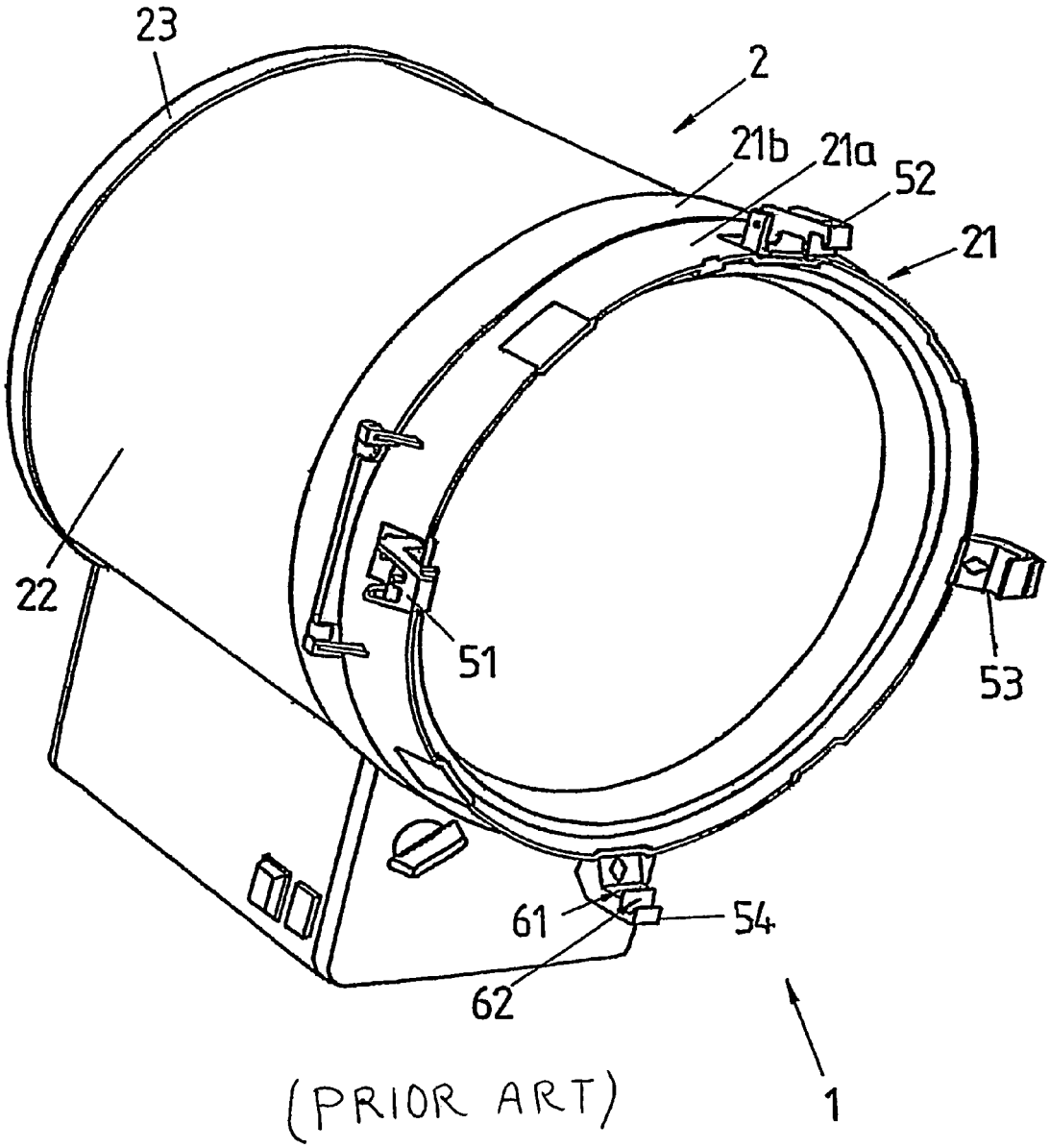
FIG. 5 is the headlight known from the prior art.

Furthermore it should be pointed out that the upper fixing claw 520 is provided corresponding to the fixing claw 52 of FIG. 5 with an opening mechanism (not shown) with which the fixing claw can be tilted away upwards in order to make it easier to insert or remove an accessory device in the fixing claws 510, 520, 530, 540.

Figure 3:
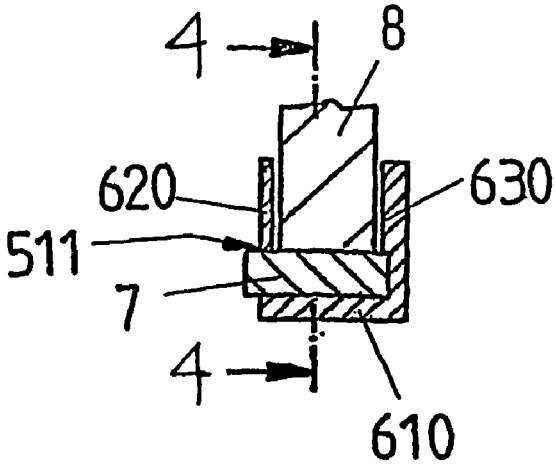
FIG. 3 is a section through a fixing claw according to the invention in an enlarged view.
Figure 4:
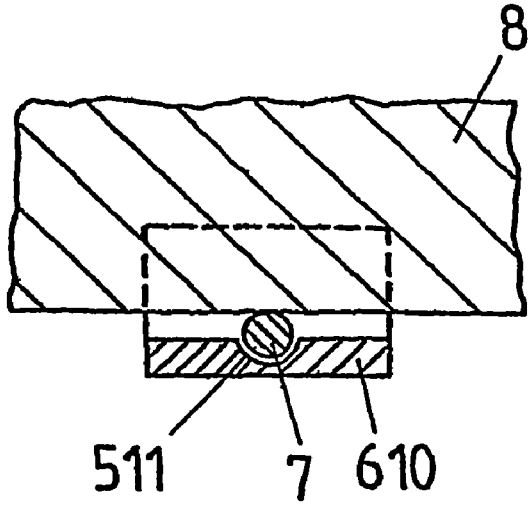
FIG. 4 is a section through the fixing claw of FIG. 3 along the line 4—4.

As can be seen in particular from the sectional views of FIGS. 2 to 4 the fixing claws 510, 520, 530, 540 each have a bore 511 in which is inserted a cylindrical pin 7 made of an elastic material (for example an elastomer). The bore 511 thereby extends across the groove 600 and as shown in FIG. 4 is embedded partially in the groove base 610. Thus the bore 511 runs from the outside arm 620 of the groove 600 towards the inside arm 630 of the groove 600. In the region of the groove base 610 the bore 511 is designed as a half-bore so that part of the pin 7 protrudes away from the groove base.

An accessory device 8 inserted in the groove 600 (and shown diagrammatically in FIGS. 3 and 4) therefore adjoins the elastic pin 7 and not however the groove base 610. The elastic pin 7 therefore has a diameter such that even when taking into account manufacturing tolerances and as a result of tolerances arising from thermal differences of both the insert device 8 and the fixing claws, the insert device 8 presses resiliently against the elastic element 7 and bears against same. A solid, rattle-free seat of the accessory device 8 in the socket groove 600 is thereby produced.

As a result of the elastic seat of the radial end of the socket device 8 against the elastic element 7 and a relatively high friction connected therewith between the socket device 8 and the elastic element 7, movement of the socket device 8 in the axial direction in the groove 600 is also prevented.

The elastic pin 7 is preferably pressed into the opening 511 in the arm 620 of the groove so that it has a fixed seat. As an alternative or in addition the elastic pin is stuck into the bore 511 in order to sit securely in the fixing claw.

It should be pointed out that the pin 7 according to FIGS. 2 and 3 protrudes slightly axially relative to the fixing claw or groove 600 and its arm 620. An additional noise damping hereby takes place in the axial direction relative to parts and devices bearing externally on the fixing claw.

Figure 6A:
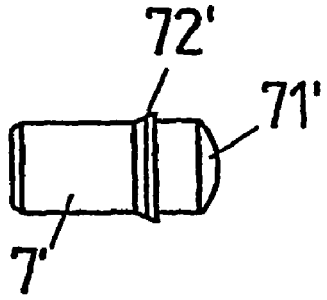
FIG. 6*a* is a side view of an elastic element formed as an elastic tubular segment.
Figure 6B:
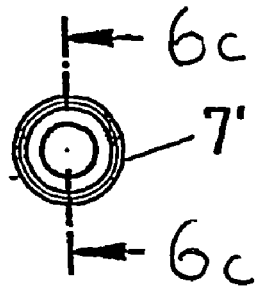
FIG. 6*b* is a front view of the tubular segment of FIG. 6*a;*
Figure 6C:
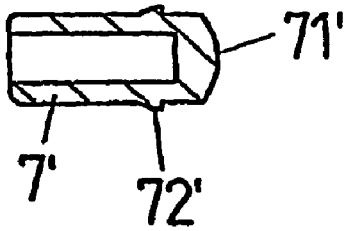
FIG. 6*c* is a section through the tubular segment of FIG. 6*b* along the line 6*c*—6*c*.

FIGS. 6*a–c* show a further embodiment of an elastic element. The elastic element is formed as a tubular segment 7' which is inserted in the groove 600 of the corresponding fixing claw as just described in respect of FIGS. 2 to 4. The tubular segment 7' is for example a silicon rubber part with a shore hardness of 60 Shore.

The tubular segment 7' is closed on its region 71' projecting out from the bore 511 (see FIG. 3) and is formed ball-shaped. Detent hooks 72' provided on the circumference prevent it accidentally falling out from the bore 511. In addition the tubular segment 7 is preferably secured by a suitable adhesive in the bore 511 (see FIG. 3).

Figure 7:
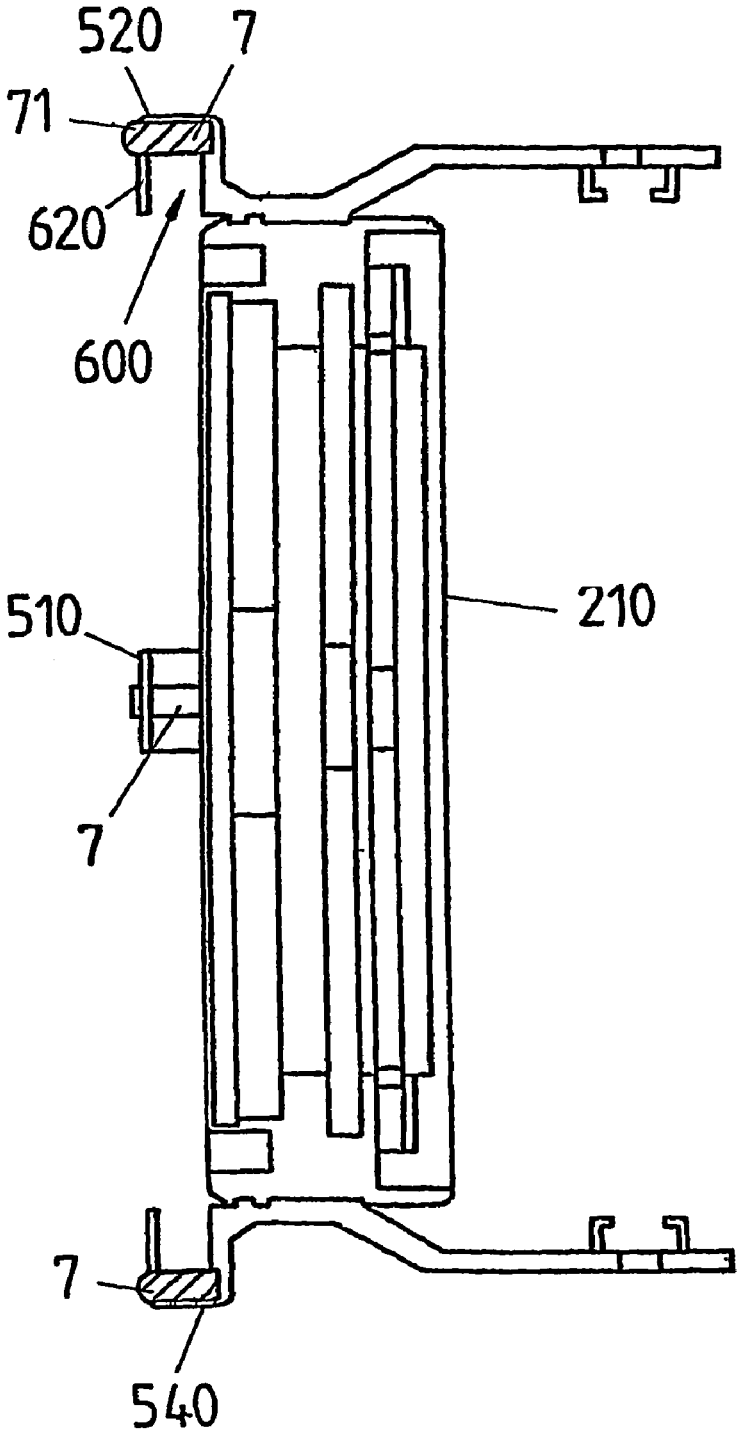
FIG. 7 is an embodiment of a front part corresponding to the embodiment of FIG. 2 whereby the elastic elements are formed ball-shaped at one end.

In FIG. 7 an embodiment is shown which corresponds to the embodiment of FIG. 2 except for the feature that the region 71 of the pin 7 protruding axially relative to the fixing claw 520, 540 or the groove 600 and its arm 620 is ball-shaped. This enables noise damping also in the axial direction.

The invention is not restricted in its design to the embodiment illustrated above. It likewise is within the scope of the invention to use for example as the elastic element instead of an elastic pin or a tubular segment a groove shaped insert part which is inserted in the groove of a fixing claw and bears radially and axially against an accessory device inserted in the groove. It can also be proposed that the groove base is coated with a rubber lining.

As noted above, the fixing claw can have or form an elastic element against which rests an accessory device of a headlight held by the fixing claw.

The invention claimed is:

1. A headlight with a housing in which light generating and light forming elements are arranged, comprising:

a front part of the housing or a top, insert or adapter connected to the front part of the housing having at least two fixing claws for fixing accessory devices which are attachable by the fixing claws at a light output of the headlight, the fixing claws each having or forming an elastic element against which rests the accessory device fixed by the fixing claw, wherein the elastic element is a pin made from an elastic material or a tubular segment made from an elastic material and is inserted axially into a bore of the fixing claw relative to the headlight.

2. The headlight according to claim 1, wherein the fixing claws each have at least one recess for holding the accessory devices and the elastic element is mounted in the at least one recess.

3. The headlight according to claim 2, wherein the at least one recess is a groove and the elastic element is pushed crosswise through the groove and thereby protrudes at least in part opposite a groove base.

4. The headlight according to claim 3, wherein the bore for holding the elastic element is designed in the region of the groove base as a half bore.

5. The headlight according to at least one of the preceding claims, wherein the elastic element protrudes axially relative to the fixing claw.

6. The headlight according to claim 5 wherein an axially protruding region of the elastic element is rounded.

7. Headlight according to claim 1, wherein the elastic element is additionally secured by an adhesive to the fixing claw.

8. The headlight according to claim 1, wherein the elastic element is cylindrical.

9. The headlight according to claim 2, wherein the elastic element is an insert part which is inserted in the at least one recess.

10. The headlight according to claim 1, wherein the elastic element has an elasticity relative to the fixing claws.

11. The headlight according to claim 1, wherein four fixing claws are evenly spread out on the front part of the housing or a top, insert or attachment connected to the front part of the housing.

12. The headlight according to claim 11, wherein one of the claws is fixed where it can tilt on the front part or on the top, insert or attachment.

13. The headlight accordingly to claim 1, wherein the accessory devices are selected from the group consisting of diffusers, colour film filters and wing elements.

* * * * *